US005502876A

United States Patent [19]

Wang

[11] Patent Number: 5,502,876

[45] Date of Patent: Apr. 2, 1996

[54] PULL HANDLE FOR A TRUNK

[76] Inventor: Chie-Shan Wang, No. 80, Lin 8, Tien Hsin Li, Yuan Li Chen, Miao Li Hsien, Taiwan

[21] Appl. No.: 309,506

[22] Filed: Sep. 22, 1994

[51] Int. Cl.[6] ..... B25G 1/04

[52] U.S. Cl. ..... 16/115; 280/655

[58] Field of Search ..... 16/115, 111 A, 16/111 R; 280/47.31, 47.315, 47.371, 655, 655.1; 190/14, 15 R, 104, 18 A, 18 R

[56] References Cited

U.S. PATENT DOCUMENTS

| | | | |
|---|---|---|---|
| 4,256,320 | 3/1981 | Hager | 190/18 A |
| 4,577,877 | 3/1986 | Kassai | 16/115 |
| 4,616,379 | 10/1986 | Lio | 16/115 |
| 4,974,871 | 12/1990 | Mao | 280/651 |
| 5,178,404 | 1/1993 | Chen | 16/115 |
| 5,367,743 | 11/1994 | Chang | 16/115 |
| 5,371,923 | 12/1994 | Chang | 280/655 |

*Primary Examiner*—Maurina T. Rachuba
*Assistant Examiner*—Chuck Y. Mah
*Attorney, Agent, or Firm*—Browdy and Neimark

[57] ABSTRACT

An improved pull handle for use on a trunk is equipped with a pair of driving rods each having a wedge member disposed at the bottom end thereof which is in abutment with a spring biased locking seat having an oblique cam surface. Each driving rod is housed in a hollow tube and the locking seat is in selective engagement with one of a plurality of spaced retaining slots disposed on a movable sleeve which accommodates each hollow tube. A pressing button housed in the handle embodiment of the pull handle with a part thereof exposed externally for hand operation is in engagement with both ends of a pair of pivot levers which are pivotally fixed at the center thereof to the handle embodiment respectively. The other ends of the pivot levers are engaged with the driving rods at the opposite end thereof whereby the actuation of the pressing button will drive simultaneously both the driving rods to free the two sleeves so as to permit the sleeves to extend or retract and relock the same in place after the length of the pull handle is varied.

2 Claims, 4 Drawing Sheets

PULL HANDLE FOR A TRUNK

BACKGROUND OF THE INVENTION

The present invention is related to an improved pull handle for a trunk and particularly to a pull handle having two parallel arms which can both be controllably positioned with readiness in operation, making the positioning of the pull handle in a firmer manner.

Most trunks of large or medium size sold in markets are equipped with a pull handle of various types so as to facilitate carrying of the same in journey. The conventional pull handles have some disadvantages in structure and are easily damaged or out of order in operation. Taking the prior art pull handle as shown in FIG. 1 for example, the handle portion 6 and the arm portions 7 are integrally formed. With each arm portion 7 is associated a tube 8 and a rubber ring 9 having an eccentric hole 91 is attached to the bottom end thereof. A mushroom-shaped stop cap 81 is secured to the top of each tube 8 in which each arm portion 7 can slidably move up and down in adjustment.

Such prior art pull handle has some disadvantages in practical operation given as below:

1. It is effort-taking to pull up or push down the pull handle in adjustment of the length thereof because the eccentrically positioned rubber ring 9 produces large friction against the arm portion 7, making a person adjust the handle with both hands.
2. The eccentric rubber ring 9 is easily worn out in use, resulting in sudden loosening of the pull handle in operation due to loss of friction between the rubber ring 9 and the arm portion 7.

SUMMARY OF THE INVENTION

Therefore, the primary object of the present invention is to provide an improved pull handle which is easy and effortless to operate, Another object of the present invention is to provide an imp,roved pull handle which is easy to assemble.

One further object of the present invention is to provide an improved pull handle which is equipped with a pair of parallel arms which both can be firmly positioned with ease.

DETAILED DESCRIPTION OF THE PRESENT INVENTION

Figure 1:
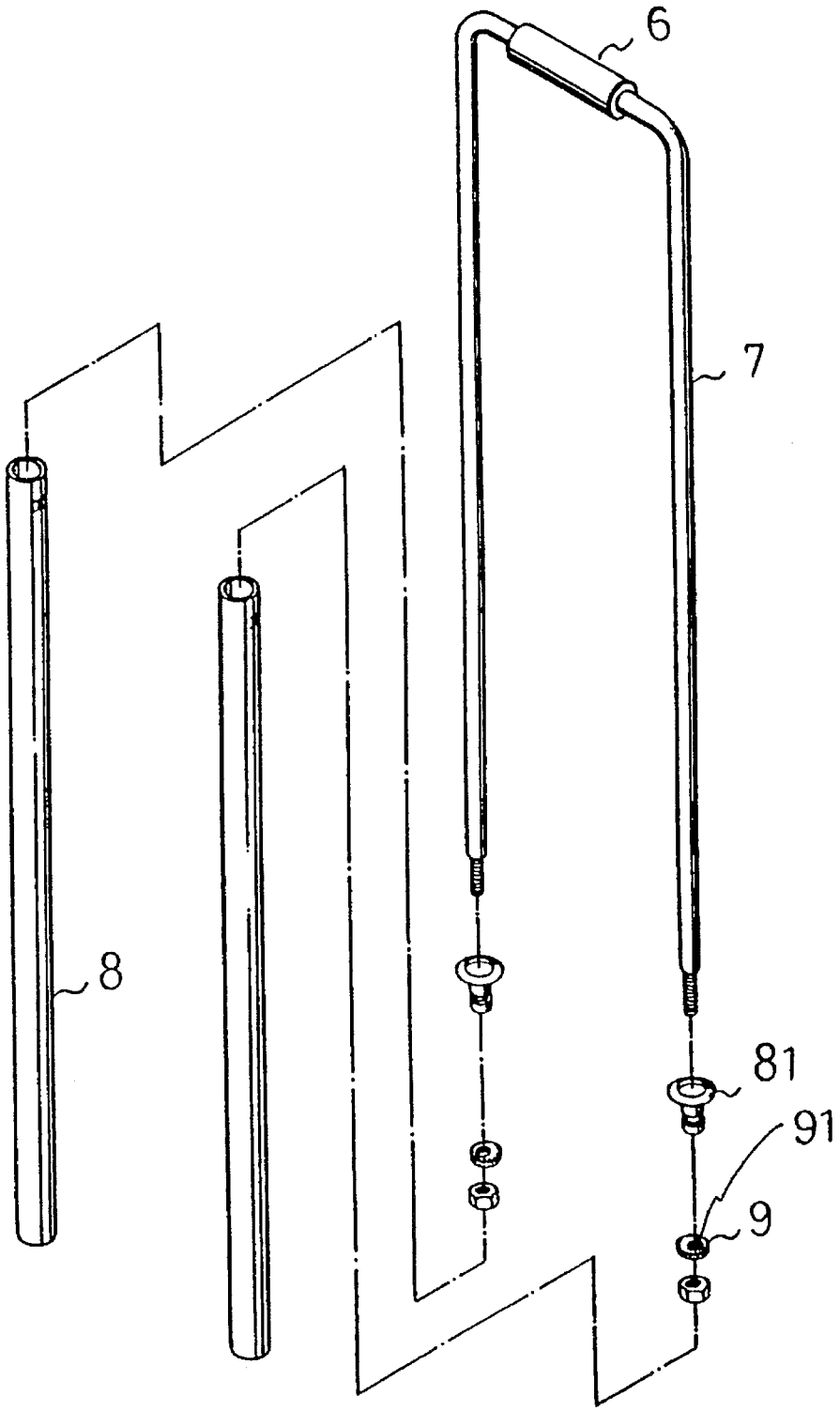
FIG.1 (PRIOR ART)
FIG. 1 is a diagram showing a prior art pull handle for use on a trunk.
Figure 2:
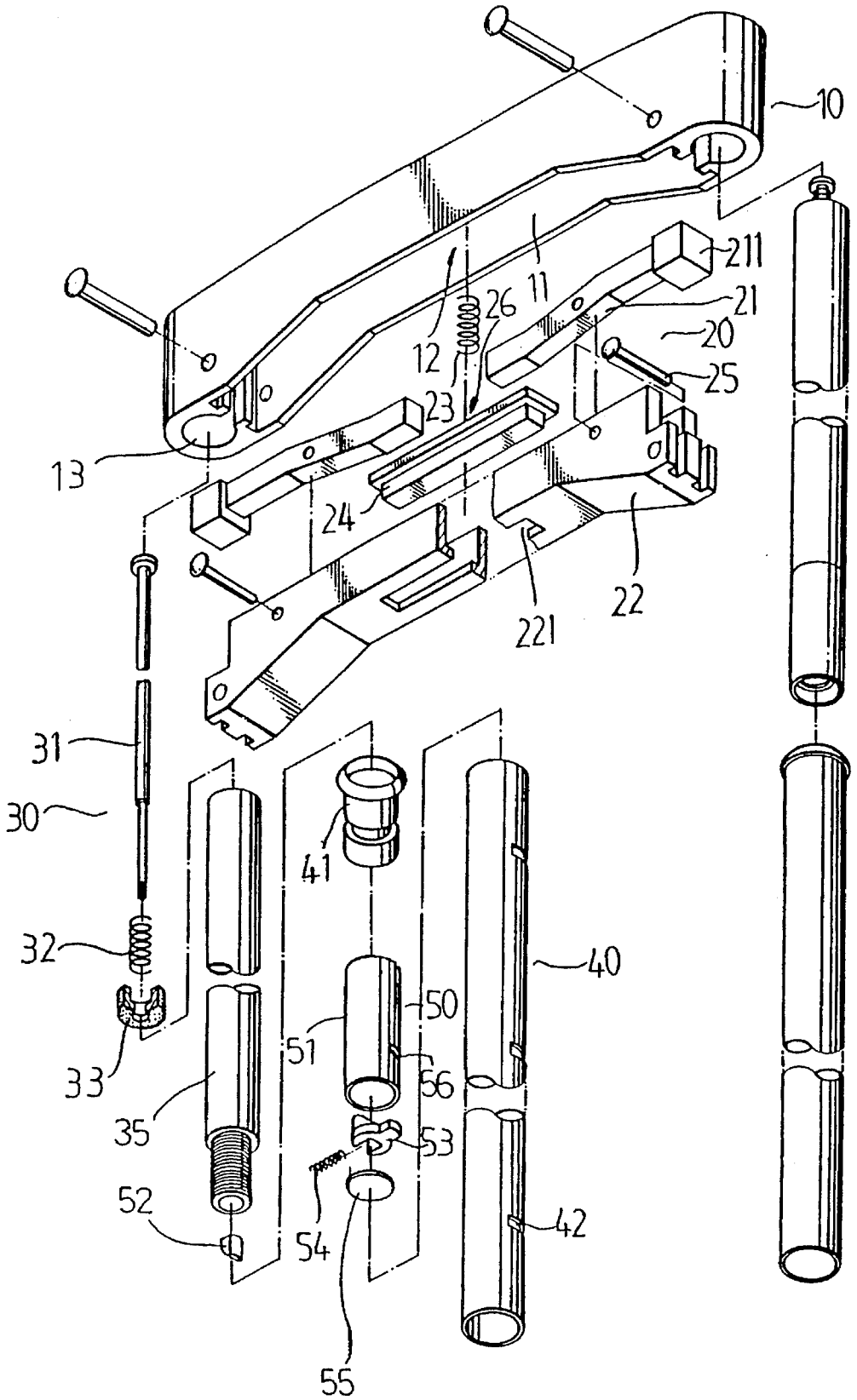
FIG. 2 is a perspective diagram showing the exploded components of the present invention.
Figure 3:
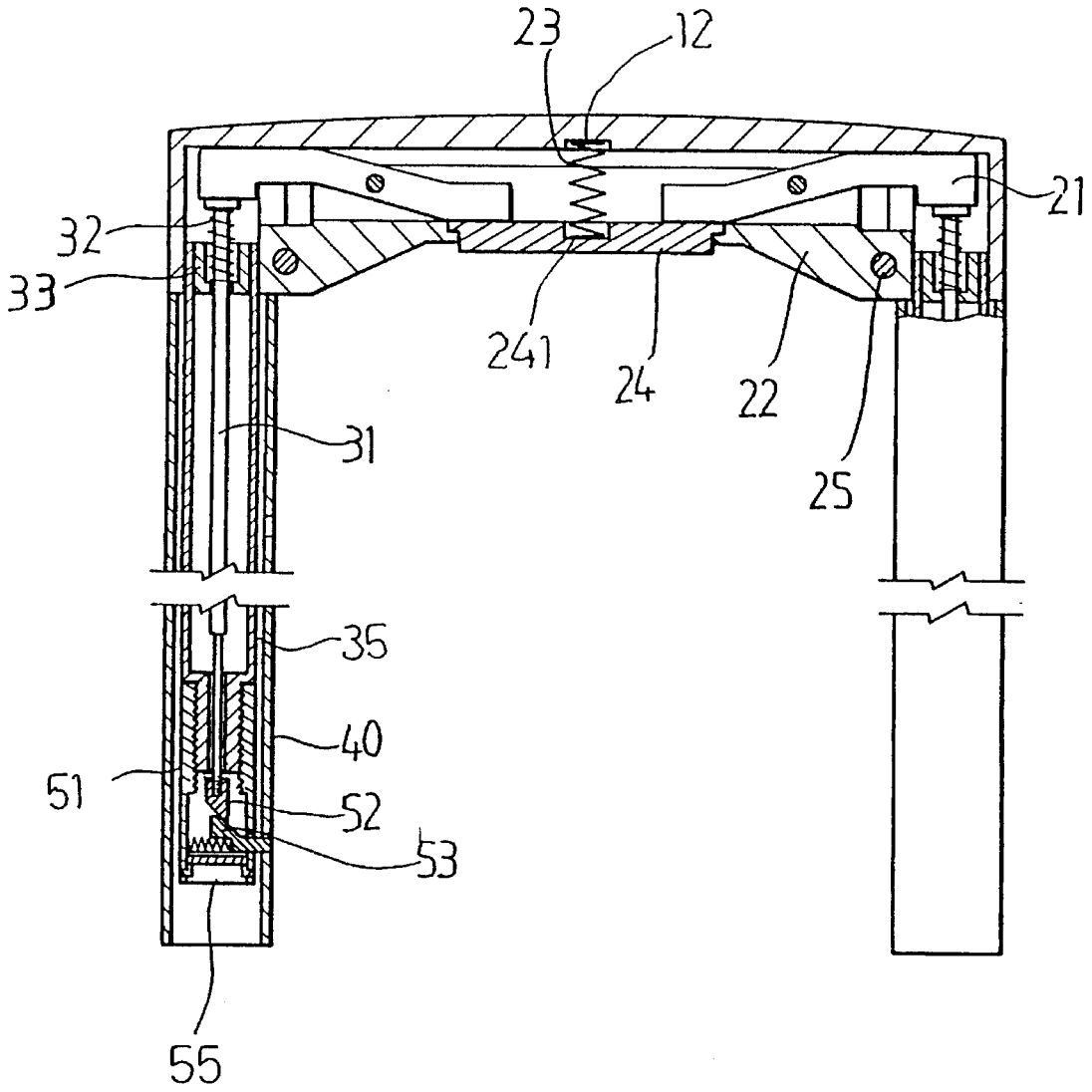
FIG. 3 is a sectional view of the assembly of the present invention.
Figure 4:
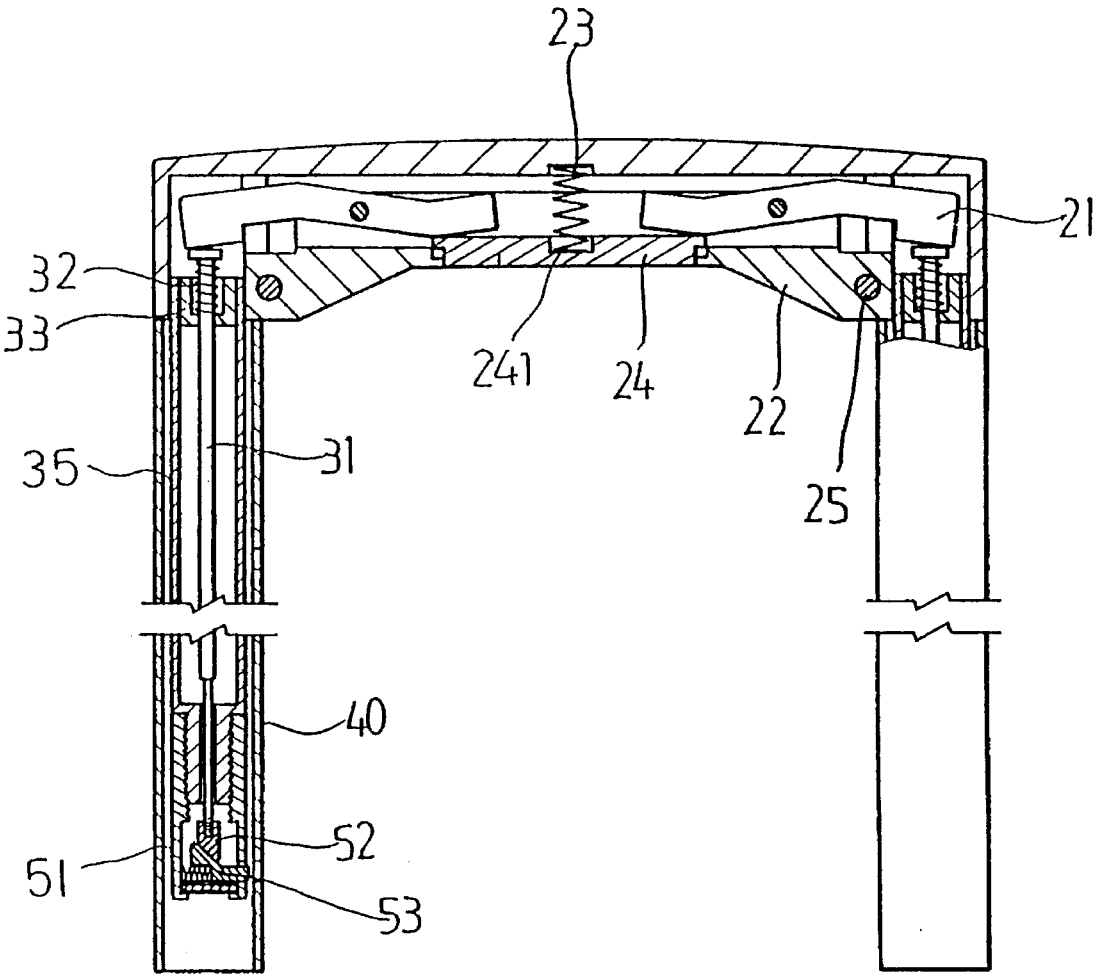
FIG. 4 is a diagram showing the operation mode of the present invention.

Referring to FIG. 2, the pull handle of the present invention is comprised of a handle embodiment 10, a control mechanism 20, and a pair of arm assemblies 30 and a pair of sleeves 40 and a pair of detent assemblies 50.

Each arm assembly 30 has a driving rod 31 and a hollow tube 35 which is housed inside the sleeve 40. To the top end of the Sleeve 40 is secured a stop cap 41 and the sleeve 40 is further provided with a plurality of spaced retaining slots 42. A spring 32 with a spring mount 33 is engaged With the topmost end of the driving rod 31 which is led through the hollow tube 35 so that the driving rod 31 can be retractably operated.

Ah abutment wedge 52 screwed to the bottom end of the driving rod 31. A housing sleeve 51 is screwed to the bottom end of the hollow tube 35. A slidable locking seat 53, a spring 54 and a round end plate 55 are received inside the housing sleeve 51. On the wall of the housing sleeve 51 is disposed a slot 56 through which the locking seat 53 is led and selectively engaged with one of the retaining slots 42 for locking purposed. The spring 54 is engaged with the locking seat 53 having an oblique surface in conformance to the abutment wedge 52, permitting the locking seat 53 to be retractably driven back and forth when the seat 53 is urged by the driving rod 31.

The handle embodiment 10 is provided with a housing cavity 11 in which is received the control mechanism 20 and adjacent to the respective end of the cavity 11 is a vertical round hole 13 for housing part of the arm assembly 30. At the center of the cavity 11 is disposed a round recess 12 for fixing one end of a biasing spring 23.

The control mechanism 20 is comprised of a pair of pivot lever 21, the spring 23, and an elongated pressing button 24 and a handle seat 22. As mentioned above, one end of the biasing spring 23 is engaged with the recess 12 of the cavity 11 and the other end thereof is fixed to a recess 26 disposed at the center of the pressing button 24.

The center of the obliquely disposed pivot levers 21 are pivotally secured to the hollow handle embodiment 10 and housed inside the housing cavity 11 with the pressing button 24 in abutment against one end of both the pivot levers 21. The center of the handle seat 22 which is fixed in combination to the handle embodiment 10 by rivet pins 25 is provided with a central opening 221 in conformance to the shape of the pressing button 24 so that the pressing button 24 can be located therein with part of it protruding out for easy actuation by hand so that an operator can pivotally actuate simultaneously the pivot levers 21.

At the opposite end of each pivot lever 21, away from the end which is in abutment against the pressing button 24, is disposed a block 211 which is in urging contact with the topmost end of the spring biased driving rod 31 whereby, when the pressing button 24 is pressed inwardly, the levers 21 are pivoted in such a manner that the block 211 will drive the driving rods 31 to move downwardly.

On the wall of each sleeve 40 are disposed a plurality of spaced slots 42 with which the locking seat 53 can be selectively engaged for variation of the length of the pull handle. As described above, once the pressing button 24 is actuated, both the driving rods 31 are urged downwardly, the wedges 52 will push the locking seats 53 having an-oblique cam surface simultaneously to slide inwardly, disengaged from one of the retaining slots 42, permitting the sleeves 40 to freely extend or retract in adjustment of the length of the pull handle.

In summary, it can be apparently seen that the present invention is provided with a pair of sleeves 40 which can be simultaneously actuated to extend or retract by pressing the pressing button 24. Accordingly, the pressing button 24 will cause a pair of pivot levers 21 pivotally fixed in place at the centers thereof to pivot against both the driving rods 31 each having a wedge 52 at the end thereof to push a locking seat 53 inwardly, permitting both the sleeves 40 to disengage from the locking seats 53 simultaneously. By pulling up or pushing down the handle embodiment 10, the length of the pull handle can be easily adjusted. All the pressing button 24 and the driving rods 31 and the locking seats 53 are retrievably actuated, so the sleeves 40 are easily locked in position again, once the pressing button 24 is released and the locking seats 53 are respectively in alignment with one of the retaining slots 42 on the sleeves 40 automatically so as to relock the sleeves 40 in place and fixed the pull handle at a proper length.

I claim:

1. A pull handle for use on a trunk, comprising:

a handle embodiment having a cavity;

a control means housed in said cavity of said handle embodiment;

a pair of tubular sleeves each having a plurality of spaced retaining means disposed on a wall thereof;

a pair of retrievably actuated driving rods each having a actuation means disposed at a bottom end thereof;

each driving rod being housed in a hollow tube;

each said hollow tube being respectively secured to each end of said handle embodiment;

each hollow tube being received in each of said pair of tubular sleeves with said hollow tube relatively movably therein;

a handle seat fixedly engaged with said handle embodiment and having an opening at a center thereof with said control means received in said cavity of said handle embodiment;

a button means protruded from said central opening and being in controlling engagement with said control means housed in said handle embodiment;

each said driving rod being spring biased and housed in said hollow tube;

a pair of spring biased locking means each being received in a housing sleeve having a slot for the protrusion of said locking means which is in engagement with said actuation means of said driving rod and in selective engagement with one of said retaining means on each of said pair of tubular sleeves;

each said housing sleeve being screwed to said hollow tube and having a stop plate disposed at a bottom end thereof for supporting said spring biased locking means in place so as to permit said locking means to be retrievably actuated by said corresponding driving rod to free each of said pair of tubular sleeves from the locking means, permitting each of said pair of tubular sleeves to extend or retract for variation of the length of said pull handle;

a stop cap being disposed at the top end of each said housing sleeve;

said button means being spring biased and in engagement with said control means.

2. A pull handle as claimed in claim 1 wherein said control means is comprised of a pair of symmetrically disposed lever means which are pivotly fixed at the center thereof to said handle embodiment and are in contact with said button means at a first end thereof; at a second end of each said lever means a contact block is provided which is in abutment with the topmost end of said spring biased driving rod, whereby when said button means is pressed, both said lever means are pivoted to simultaneously drive said driving rods downwardly to free said locking means from said retaining means of both said pair of tubular sleeves, permitting said pair of tubular sleeves to extend or retract for variation of the length of said pull handle by actuation of said handle embodiment upwardly or downwardly.

* * * * *